US005388739A

United States Patent [19]

Gargan

[11] Patent Number: 5,388,739

[45] Date of Patent: Feb. 14, 1995

[54] COMMUTER TICKET HOLDER

[76] Inventor: Virginia Gargan, 12 Alton Ct., North Merrick, N.Y. 11566

[21] Appl. No.: 180,843

[22] Filed: Jan. 12, 1994

Related U.S. Application Data

[63] Continuation-in-part of Ser. No. 988,866, Dec. 10, 1992, abandoned.

[51] Int. Cl.[6] ..... A45C 1/06

[52] U.S. Cl. ..... 224/202; 40/586; 40/661; 224/207

[58] Field of Search ..... 224/191, 199, 202, 205, 224/207, 253, 254, 257; 150/128; 40/661, 1.6, 159, 586

[56] References Cited

U.S. PATENT DOCUMENTS

| | | | |
|---|---|---|---|
| D. 252,355 | 7/1979 | Uber | 224/202 X |
| 4,020,660 | 5/1977 | Goto | 40/159 X |
| 4,744,497 | 5/1988 | O'Neal | 224/202 |
| 4,899,879 | 2/1990 | Rosen | 40/159 X |
| 4,955,153 | 9/1990 | Albrecht et al. | 40/661 |
| 5,178,311 | 1/1993 | McBride | 224/202 X |
| 5,201,525 | 4/1993 | Castro | 40/159 X |

*Primary Examiner*—Renee S. Luebke
*Attorney, Agent, or Firm*—Galgano & Burke

[57] ABSTRACT

A commuter ticket holder includes a generally rectangular, relatively thin, plastic envelope including a commuter ticket front panel defining a transparent window and a commuter ticket back panel, each of the commuter ticket panels having top, bottom and side edges, the bottom and side edges of the commuter ticket front and back panels being sealed together to define a pocket having an open top end in which a commuter ticket may be inserted for display through the transparent window. The envelope also has front and rear neck band panels disposed above and joined to the commuter ticket panels. The neck band front and rear panels having top, bottom and side edges, portions of which are sealed together to define two openings at the side edges thereof and a continuous passageway between the two openings. A separate neck band forming a loop adapted to fit around a user's neck is received through the passageway and extended through the open ends of the front and rear neck band panels.

5 Claims, 1 Drawing Sheet

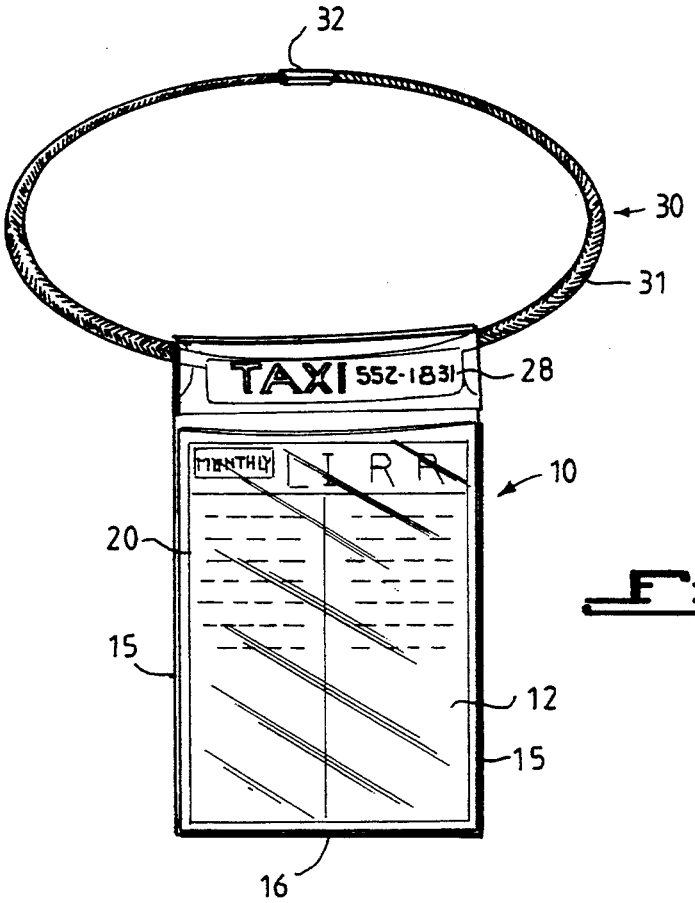
Fig. 1
Fig. 2
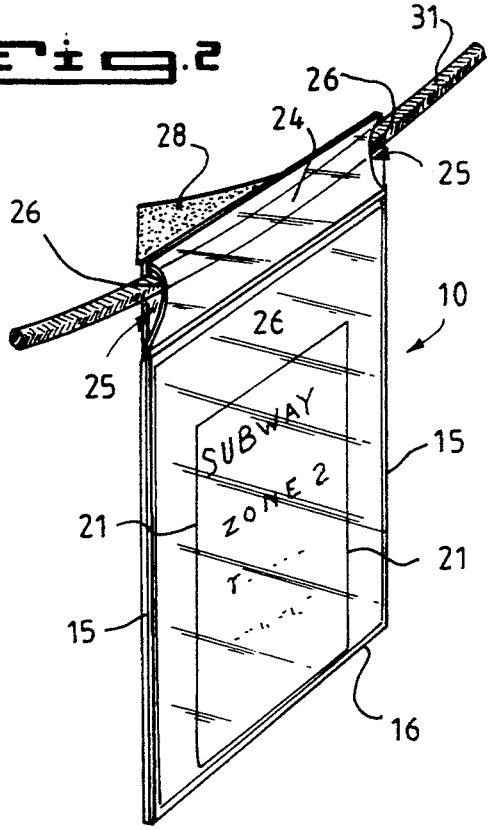
Fig. 3
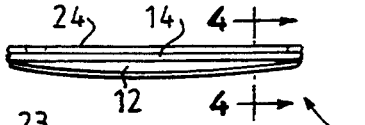
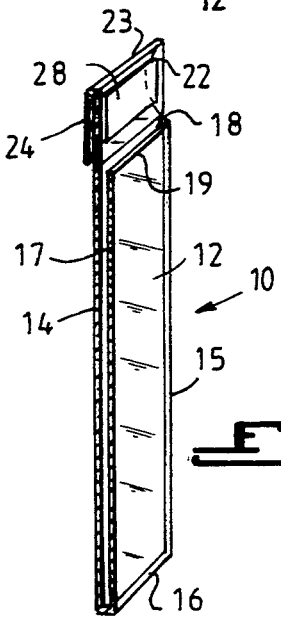
Fig. 4

COMMUTER TICKET HOLDER

RELATED APPLICATION

This application is a continuation-in-part of application Ser. No. 07/988,866, filed Dec. 10, 1992 and now abandoned.

BACKGROUND OF THE INVENTION

1. Field of the Invention

The present invention relates to ticket holders and, more particularly, to a commuter ticket holder which may be worn on the neck so as to continuously display a commuter ticket.

2. Prior Art

Commuters riding trains must show their tickets periodically to the train conductor. This requires the pulling out of one's wallet or the emptying of one's pockets to locate the ticket, which is troublesome and time consuming; especially in the cold weather when people are wearing heavy outer clothing, and the ticket may be misplaced or lost in this process. Also, the rider may be sleeping and has to be rudely awakened by the conductor.

While various pouches are known for holding a variety of items, such as ski area trail maps (U.S. Pat. No. 5,178,311), a Keno games (U.S. Design Pat. No. 252,353), water sensitive, medical or electronic apparatus (U.S. Pat. No. 4,793,486), and while various security wallets are known having loop attachment means (see, for example, U.S. Pat. Nos. 4,570,688 and 4,744,497), so far as is known, nowhere in the prior art is there any suggestion of a commuter ticket holder having a neck band which is specifically designed to allow for proper positioning and viewing of the ticket at all times while being worn by the commuter in a simple and highly effective manner as hereinafter proposed.

SUMMARY OF THE INVENTION

Accordingly, it is an object of the present invention to provide a new and improved ticket holder which may be worn around the user's neck so as to continuously display a ticket and, in particular, a railroad commuter ticket.

It is a further object of the present invention to provide such a new and improved ticket holder which is of relatively simple in design, inexpensive to produce and easy and facile to use.

Certain of the foregoing and related objects are readily attained in a commuter ticket holder which includes a generally rectangular, relatively thin, plastic envelope including a commuter ticket front panel defining a transparent window and a commuter ticket back panel, each of commuter ticket panels having top, bottom and side edges, the bottom and side edges of the commuter ticket front and back panels being joined or sealed together to define a pocket having an open top end in which a commuter ticket may be inserted for display through said transparent window. The envelope also has front and rear neck band panels disposed above and joined to the commuter ticket panels. The neck band front and rear panels have top, bottom and side edges, portions of which are joined or sealed together to define two openings at the side edges thereof and a continuous passageway between the two openings, and a separate neck band forming a loop is adapted to fit around a user's neck and is received through the passageway and extends through the open ends of the front and rear neck band panels.

Preferably, the neck band is an elastic cord and the ticket holder, additionally includes a self-adhesive advertising panel affixed to at least one of the front and rear neck band panels. Most advantageously, one of the front and rear neck band panels side edges has generally semicircular cutouts formed therein adjacent the openings thereof to facilitate mounting of the neck band. Most desirably, the envelope is made from one piece of plastic material which is folded and heat sealed into the desired ticket holder configuration.

BRIEF DESCRIPTION OF THE DRAWINGS

Other objects and features of the present invention will become apparent from the following detailed description considered in connection with the accompanying drawing which discloses one embodiment of the present invention. It should be understood, however, that the drawings are designed for the purpose of illustration only and not as a definition of the limits of the invention.

In the drawing, wherein similar reference characters denote similar elements throughout the several views:

FIG. 1 is a front perspective view of the commuter ticket holder and neck band embodying the present invention;

FIG. 2 is an enlarged, fragmentarily-illustrated rear perspective view of the ticket holder and neck band;

FIG. 3 is a plan view of the ticket holder; and

FIG. 4 is a sectional view taken along line 4—4 of FIG. 3.

DETAILED DESCRIPTION OF THE PREFERRED EMBODIMENT

Referring now in detail to the drawing, therein illustrated is a commuter ticket holder embodying the present invention which, as shown in FIG. 1, includes a generally rectangular, relatively thin, clear plastic envelope generally designated by reference numeral 10 and a separate elastic neck band, generally designated by reference numeral 30, which forms a loop adapted to fit around a user's neck. The plastic envelope 10 includes a transparent plastic front panel 12, and a rear rectangular transparent plastic panel 14. As seen best in FIG. 4, rear panel 14 has a length slightly longer than that of the front panel 12, the purpose of which will be described in greater detail hereinafter.

The front and rear panels 10, 12 have common side and bottom edges 15 and 16, respectively which are heat sealed together to define a pocket 17 having an open top end 18 adjacent the top end 19 of the front panel 12. As seen best in FIG. 1, the pocket is suitably dimensioned to receive a monthly railroad ticket 20 so that the same along with any pertinent data imprinted thereon is clearly visible through the transparent window of the front panel 12. The ticket 20 contains typical information, such as month of use, the valid zones for travel, a signature line, an identification number, photograph, etc., depending upon the type of ticket issued by the railroad used. In addition, as shown in FIG. 2, the pocket 17 could also be used for holding one's subway ticket 21 or the like behind the commuter ticket to allow for a relatively easy access thereto when needed, thereby allowing the commuter not to have to fumble through his or her wallet or pocketbook for this ticket when needed.

As seen best in FIGS. 2 and 4, the rear panel 14 has a top margin 22 which extends above the pocket 17 and which is joined along its top edge 23 to a rear flap 24, which is heat sealed at its top and bottom margins to the top margin 22 of rear panel 14 so as to define a continuous throughbore between the top margin 22 and rear flap 24 having opposite openings 25 at the lateral side edges thereof. The rear flap side edges are further provided with generally semi-circular cutouts 26 to facilitate the passage of an elastic neck cord 31 therethrough. The elastic cord 31 is made into the form of a loop by having the ends thereof crimped and joined together by a metal fastener 32; the elastic nature of the cord allowing it to fit over and accommodate various neck and head sizes. The mounting of the cord through the openings 25 of the throughbore such that the cord extends from the sides of the top margin of the envelope insures that the envelope will always lie flat on the wearer's upper chest area so that the ticket will be viewable at all times and allowing envelope 10 to be positioned anywhere along the chest of the user without moving cord 31 on the neck of the user. This is important to insure that the same does not twist or turn since this would defeat the purpose of utilizing the ticket holder. As a result of the foregoing construction, the conductor can see the ticket without the commuter having to wake up or show him his ticket.

As seen in FIGS. 1, 2, and 4, a self adhesive strip 28 can be optionally applied to the upper margin 22 of the envelope to provide additional advertising such as for a taxi or the like, if desired.

The envelope is preferably made from one sheet of plastic which is suitably folded and heat sealed together so as to form the product as shown in the drawing. This minimizes waste and allows for easy production of the unit.

Various modifications can be made as will be apparent to those skilled in the art. For example, although the neck band is preferably made from an elastic cord, string or other non-elastic material could be used. In addition, although the ticket holder is shown with a front opening pouch or pocket for the ticket holder, the same could of course be placed on the rear side of the ticket holder. The same applied to the top margin and rear flap as well. Although not shown, the ticket holder would also be used for ID passes used in may companies today.

Accordingly, while only one embodiment of the present invention has been shown and described, it is to be understood that many changes and modifications may be made thereunto without departing from the spirit and scope of the invention as disclosed herein.

What is claimed is:

1. A commuter ticket holder suspended from the neck of a user comprising a generally rectangular, relatively thin, plastic envelope including a commuter ticket front panel defining a transparent window and a commuter ticket back panel, each of the commuter ticket panels having top, bottom and side edges, the bottom and side edges of the commuter ticket front and back panels being sealed together to define a pocket having an open top end in which a commuter ticket may be inserted for display through said transparent window, said envelope also having front and rear neck band panels disposed above and joined to said commuter ticket panels, said neck band front and rear panels having top, bottom and side edges, portions of which are sealed together to define two openings at said side edges thereof and a continuous passageway between said two openings; and means for suspending said envelope from said neck of said user in a manner to maintain said transparent window facing outwardly at all times comprising a separate neck band forming a loop adapted to fit around a user's neck received through said passageway and extending through said open ends of said front and rear neck band panels so that said envelope is prevented from turning, and permitting said envelope to be moved along said neck band for positioning on said user.

2. The ticket holder according to claim 1, wherein said neck band is an elastic cord.

3. The ticket holder according to claim 1, additionally including a self-adhesive advertising panel affixed to at least one of said front and rear neck band panels.

4. The ticket holder according to claim 1, wherein one of said front and rear neck band panels side edges have generally semi-circular cutouts formed therein adjacent said openings thereof to facilitate mounting of said neck band.

5. The ticket holder according to claim 1, wherein said envelope is made from one piece of plastic material.

* * * * *